US009543685B2

(12) United States Patent
Mortun et al.

(10) Patent No.: US 9,543,685 B2
(45) Date of Patent: Jan. 10, 2017

(54) TAMPER RESISTANT RECEPTACLE WITH CAM FEATURE

(71) Applicant: Hubbell Incorporated, Shelton, CT (US)

(72) Inventors: Sorin Mortun, Irvington, NY (US); Athanasios Diakomis, Seymour, CT (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/798,765

(22) Filed: Jul. 14, 2015

(65) Prior Publication Data

US 2016/0013577 A1 Jan. 14, 2016

Related U.S. Application Data

(60) Provisional application No. 62/024,243, filed on Jul. 14, 2014.

(51) Int. Cl.
*H01R 13/453* (2006.01)

(52) U.S. Cl.
CPC ..... *H01R 13/4536* (2013.01); *H01R 13/4534* (2013.01)

(58) Field of Classification Search
CPC ..... H01R 13/4536; H01R 13/447
USPC ..... 439/137, 138, 145
See application file for complete search history.

(56) References Cited

U.S. PATENT DOCUMENTS

| | | | | |
|---|---|---|---|---|
| 7,445,472 | B1 * | 11/2008 | Huang | H01R 13/4536 439/138 |
| 7,455,538 | B2 * | 11/2008 | Germain | H01R 13/4534 439/137 |
| 7,753,700 | B2 * | 7/2010 | Ma | H01R 13/4534 439/133 |
| 8,187,012 | B1 * | 5/2012 | Baldwin | H01R 13/4534 439/137 |
| 8,753,149 | B2 * | 6/2014 | Lee | H01R 13/4534 439/653 |
| 2009/0239400 | A1 * | 9/2009 | Ni | H01R 13/4534 439/138 |
| 2009/0311892 | A1 * | 12/2009 | Weeks | H01R 13/4534 439/137 |
| 2013/0280931 | A1 * | 10/2013 | Weeks | H05K 5/02 439/137 |

* cited by examiner

*Primary Examiner* — Tulsidas C Patel
*Assistant Examiner* — Marcus Harcum
(74) *Attorney, Agent, or Firm* — Michael Best & Friedrich, LLP

(57) ABSTRACT

A tamper resistant electrical receptacle for use with 20 A receptacles. A pair of pivoting shutter and trap doors biased in the same direction use a cam and cam follower that moves laterally a distance sufficient to allow passage of the perpendicular portion of a neutral blade of a 20 A electrical plug when simultaneous insertion of electrical plug tines overcome the spring bias of the springs to allow the tines to access the devices hot and neutral electrical contacts. Absent simultaneous insertion, the shutter and trap doors cannot operate in tandem to provide the tines passage to the electrical contacts.

4 Claims, 7 Drawing Sheets

TAMPER RESISTANT RECEPTACLE WITH CAM FEATURE

CROSS REFERENCE TO RELATED APPLICATIONS

The present application claims the benefit of priority under 35 U.S.C. §119(e) to U.S. Provisional No. 62/024,243, filed Jul. 14, 2014, the entire contents of which are hereby incorporated by reference in their entirety.

FIELD OF THE INVENTION

The present invention relates to tamper resistant electrical receptacles. More particularly, the present invention relates to tamper resistant electrical receptacles using a cam feature to allow additional uses of devices having laterally sliding shutters spring biased to block access to the devices' electrical contacts.

BACKGROUND OF THE INVENTION

Tamper resistant receptacles are known in the art. "Tamper Resistant" or "TR" receptacles are a class of electrical receptacle outlets configured to deny access to the device's electrical contacts unless force is applied simultaneously to both the hot and neutral plug openings of the device pursuant to NEC Code 406.11 et seq. The Code and related regulatory requirements provide that not only must the outlet openings remain blocked unless force is applied to both openings at the same time, but also that any foreign object 1/32 inch or larger, must be prevented from bypassing the blocking member of a plug opening.

As will be appreciated, these requirements were enacted in response to the phenomena of small children curiously inserting a small toy or metal object into the hot or neutral opening of a receptacle and suffering electrical shock, burns, or even death.

In meeting the standard and providing the level of protection sought from these devices, the art has gravitated towards a configuration of receptacles utilizing cooperating shutter members to block access beyond the faceplate openings of the outlet. Specifically, to ensure that force directed into only one of the two blade openings is prevented from reaching the electrical contact that lies beneath, a sliding shutter mechanism is spring-biased into a position blocking (or "shuttering") the blade opening from underneath the faceplate. The shutter physically prevents an object entering the blade opening from reaching the electrical contact below that shutter. In order to allow the shutter of a respective blade opening to be uncovered, the spring-bias must be overcome by a camming action caused by the other plug blade during insertion in the other blade opening.

To this end, the most common prior art configuration of a TR receptacle includes a shutter assembly comprising a pair of cooperating shutters. Each of the shutters includes a blocking portion positioned below a respective one of the blade openings blocking access to the contacts. Each of the shutters also includes a cam portion that extends to the opposite blade opening that receives contact from a plug blade and translates the vertical force of a plug blade and camming action into a lateral sliding displacement of the blocking portion. Thus, force by vertical insertion of a plug-blade on the neutral blade opening will move the shutter from obstructing access to the electrical contact below the hot blade opening, and vice versa. Specifically, for example, during insertion of a plug, the neutral blade tine will cam against and past the shutter cam surface forcing the shutter cam arm to move laterally, thereby overcoming the spring bias of the shutter and causing the hot blade shutter blocking portion to slide into a position away from and revealing the electrical contact beneath the hot blade opening. Likewise, force on the hot blade opening will contact the cam surface and allow the blade to cam past and move the arm and compress the spring to move the shutter blocking portion that covers the neutral blade opening out of the way. As will be appreciated, with this configuration, when a child tries to insert a toy into either opening of the outlet, the blocking portion of the shutter remains immobile from the spring bias of the opposite shutter and prevents the child from reaching the electrical contact. However, when both blades of an electrical plug contact the shutters simultaneously, the simultaneous force and camming action allows both blades to continue their downward insertion by simultaneously sliding respective shutter blocking portions laterally out of the way of the electrical contacts of the opposite shutter until the blades cam past the shutters and are able to properly "plug in" to the outlet's internal face contacts.

Existing prior art TR receptacle designs and their operational details are available in U.S. Pat. No. 4,379,607 to Bowden, Jr.; U.S. Pat. No. 7,645,148 to Carbone et al.; U.S. Pat. No. 8,187,011 to Baldwin et al., and U.S. Publ. No. 2013/0295788 to Baldwin, et al. and the references cited therein, the entire contents of which are hereby incorporated by reference in their entirety.

The cam surface of most prior art devices is an inclined "ramp" of about 45° that is of a length sufficient to cause lateral displacement during insertion of a distance that is equal to the distance necessary to un-shutter a horizontal blade opening (typically about 1.8 mm). One drawback with these devices is that the ramp does not provide enough lateral movement to be effective for 20 A receptacles that have a perpendicular blade opening for the 20 A neutral plug blade. To be effective with a 20 A device, a much larger amount of lateral movement is required. The height of the receptacle logistically eliminates the ability to use a longer ramp to provide the necessary clearance. Another drawback with some prior art devices is that the respective shutters are spring-biased towards one another, meaning that additional insertion force may be necessary to overcome the friction caused by the shutters sliding over one another in opposite directions.

The foregoing underscores some of the problems associated with conventional TR receptacles. Furthermore, the foregoing highlights the long-felt, yet unresolved need in the art for a TR receptacle with cooperating shutters that is effective in 20 A receptacles having a perpendicular neutral blade receiving slot. Moreover, the forgoing highlights the long-felt, yet unresolved need in the art for a TR receptacle design that may be modified to accommodate a 20 A neutral blade at a reasonable cost.

SUMMARY OF THE INVENTION

Various embodiments of the present invention overcome various of the aforementioned and other disadvantages associated with prior art TR receptacles and offers new advantages as well. Although not wishing to be bound by theory, the present inventors' recognize that an effective mechanism for a 20 A receptacle makes use of a cam and cam follower to provide the additional movement of the neutral shutter to uncover the perpendicular neutral blade slot. An additional aspect of an effective mechanism for a 20 A receptacle is the provision of the springs to allow both shutters to slide in the same direction.

According to one aspect of various embodiments of the present invention there is provided a TR receptacle having cooperating shutter mechanisms wherein each shutter member is spring-biased in the same lateral direction.

According to another aspect of various embodiments of the present invention there is provided a TR receptacle having cooperating shutter mechanisms wherein the neutral shutter mechanism includes a cam and cam follower to allow the neutral shutter to move into a position that allows user access to the perpendicular blade receiving slot of a 20 A receptacle.

The invention as described and claimed herein should become evident to a person of ordinary skill in the art given the following enabling description and drawings. The aspects and features of the invention believed to be novel and other elements characteristic of the invention are set forth with particularity in the appended claims. The drawings are for illustration purposes only and are not drawn to scale unless otherwise indicated. The drawings are not intended to limit the scope of the invention. The following enabling disclosure is directed to one of ordinary skill in the art and presupposes that those aspects of the invention within the ability of the ordinarily skilled artisan are understood and appreciated.

BRIEF DESCRIPTION OF THE DRAWINGS

Various aspects and advantageous features of the present invention will become more apparent to those of ordinary skill when described in the detailed description of preferred embodiments and reference to the accompany drawing wherein.

DETAILED DESCRIPTION OF A PREFERRED EMBODIMENT

Figure 1:
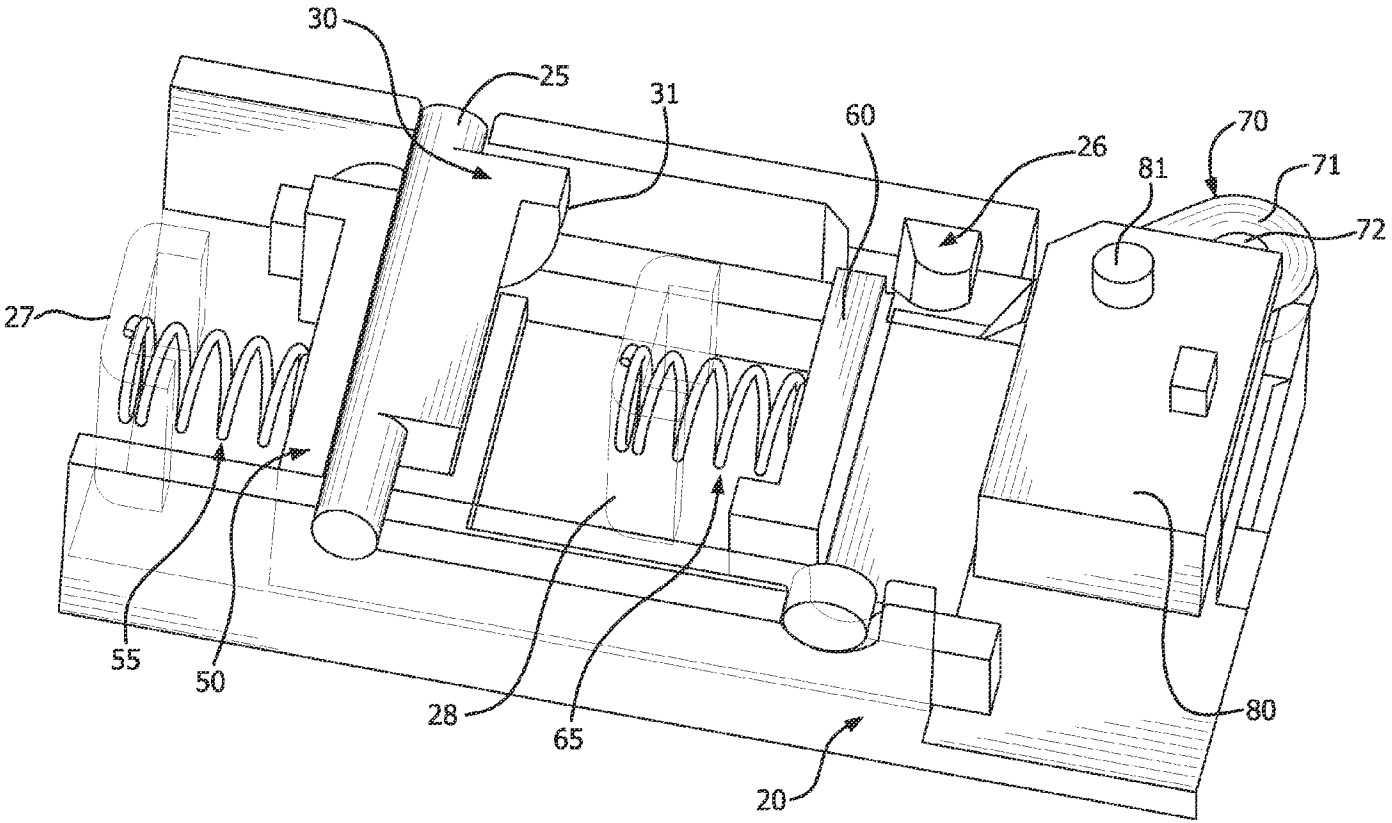
FIG. 1 is a top perspective view of a shutter assembly of a TR receptacle in the "closed" position according to an exemplary embodiment of the invention.
Figure 2:
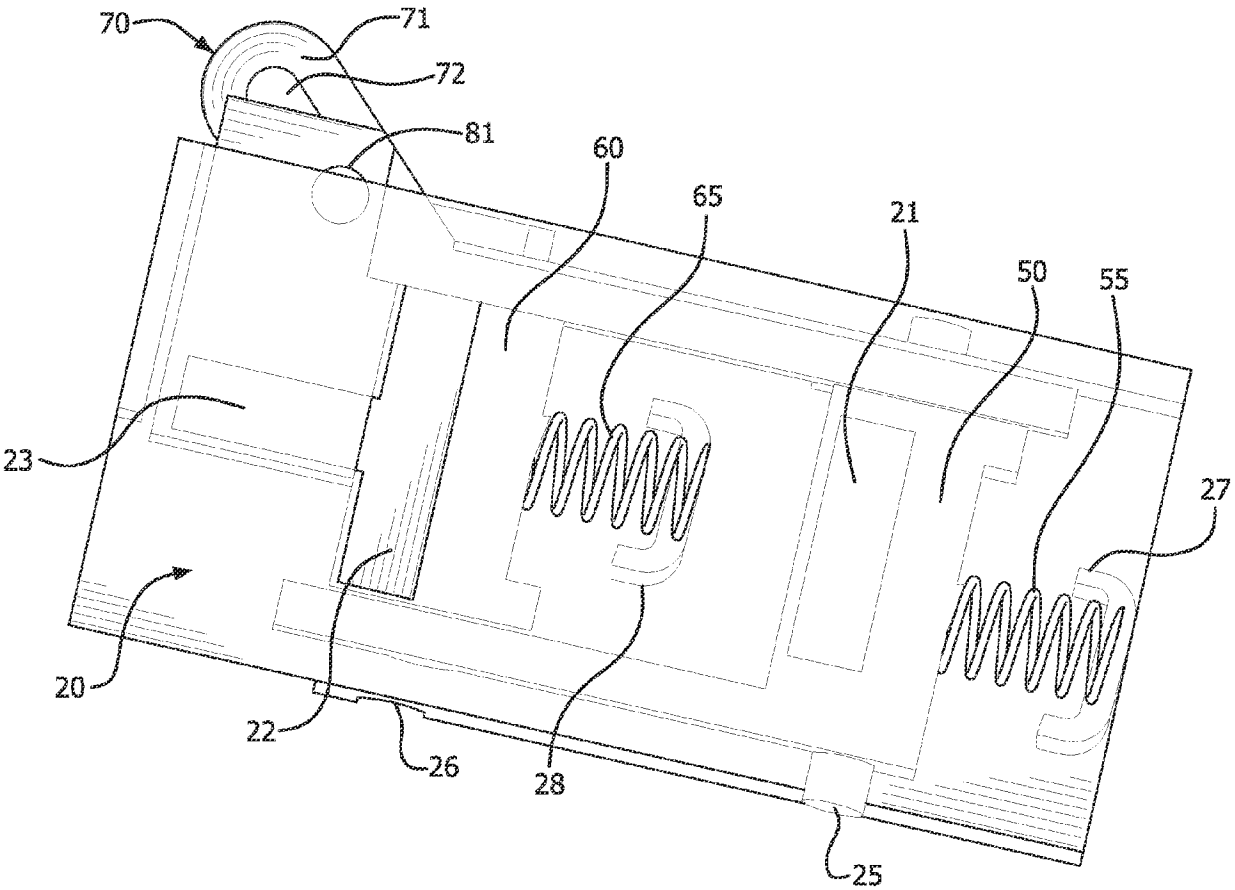
FIG. 2 is a bottom view of the shutter assembly of FIG. 1 with the shutters in the "closed" position.
Figure 3:
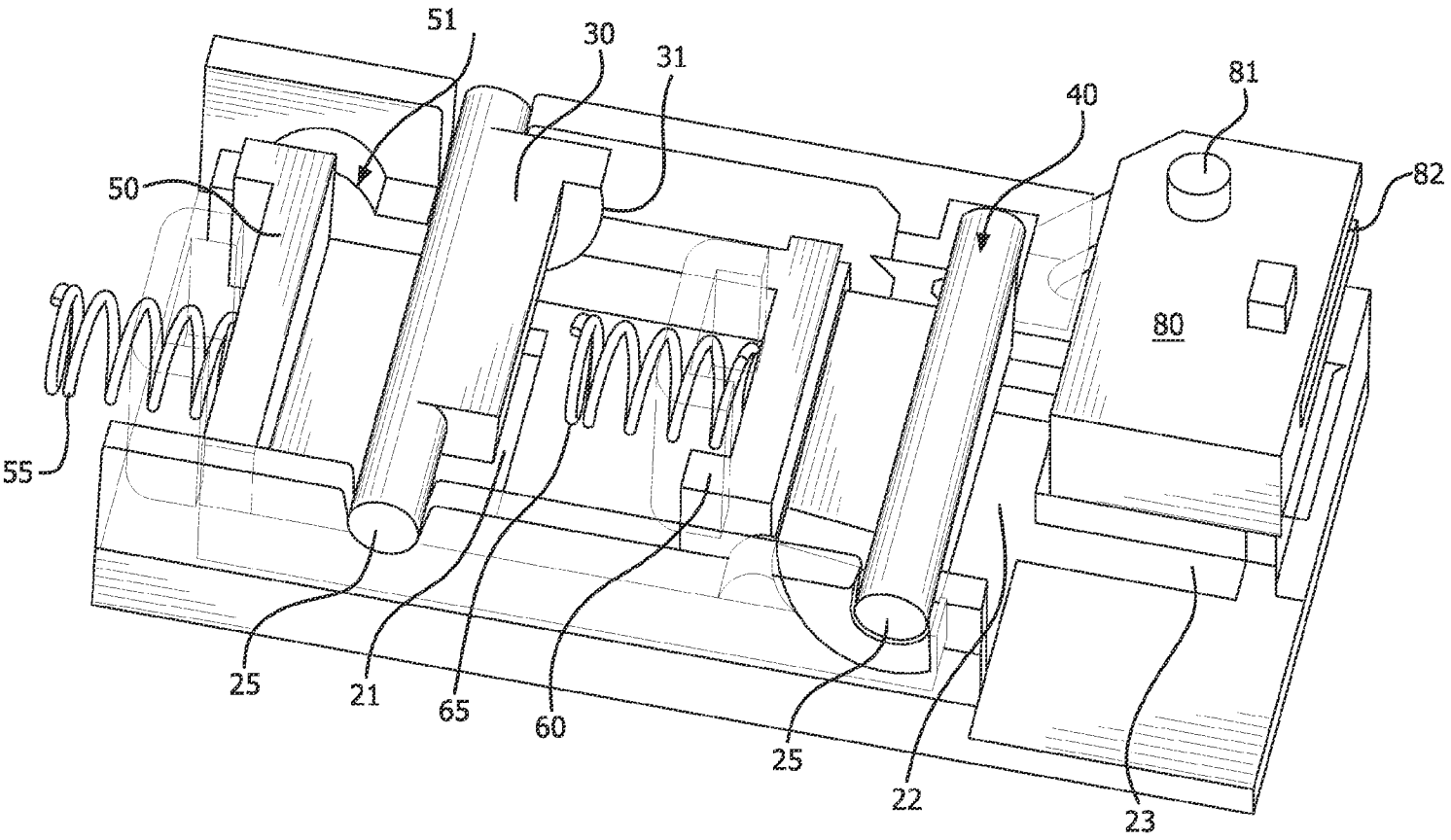
FIG. 3 is a top view of the shutter assembly of FIG. 1 with the shutters in the "open" position.
Figure 4:
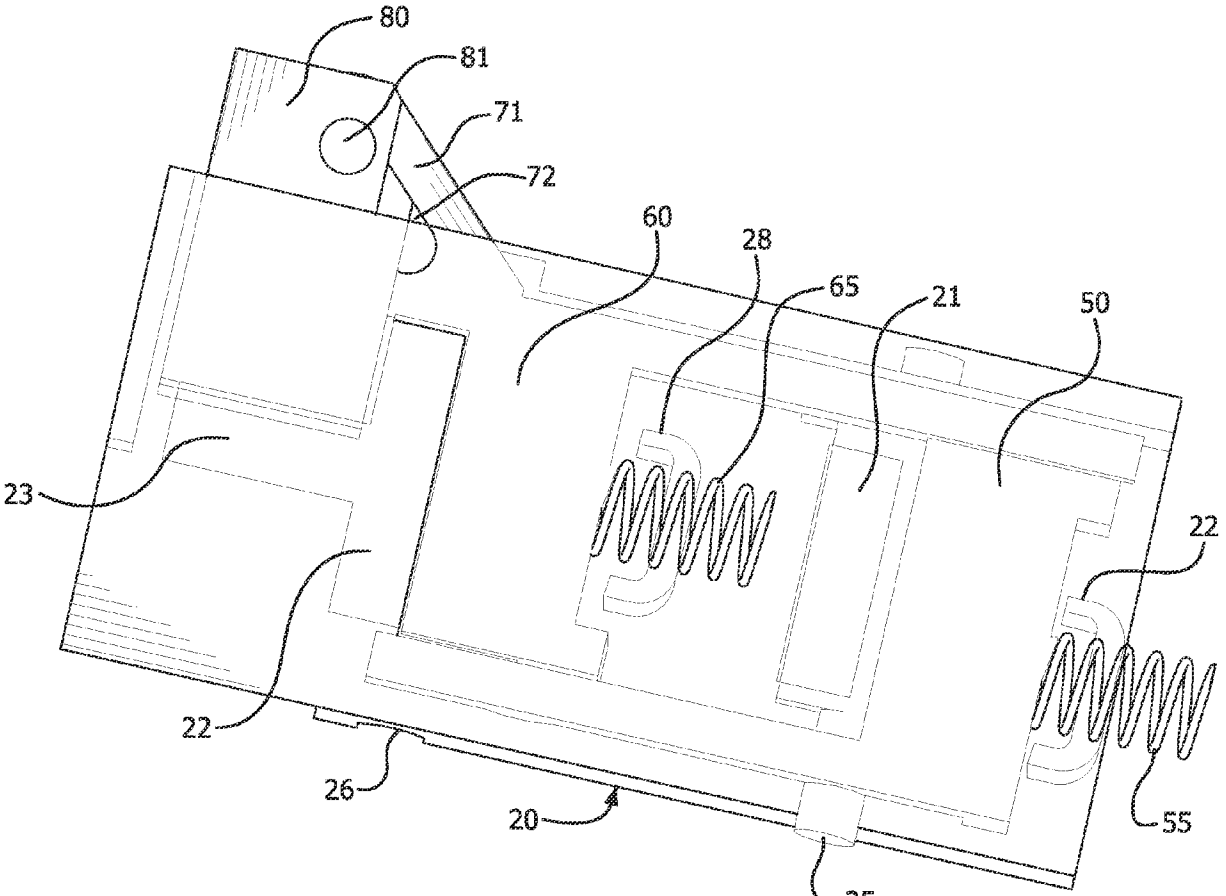
FIG. 4 is a bottom view of the shutter assembly of FIG. 1 with the shutters in the "closed" position.
Figure 5:
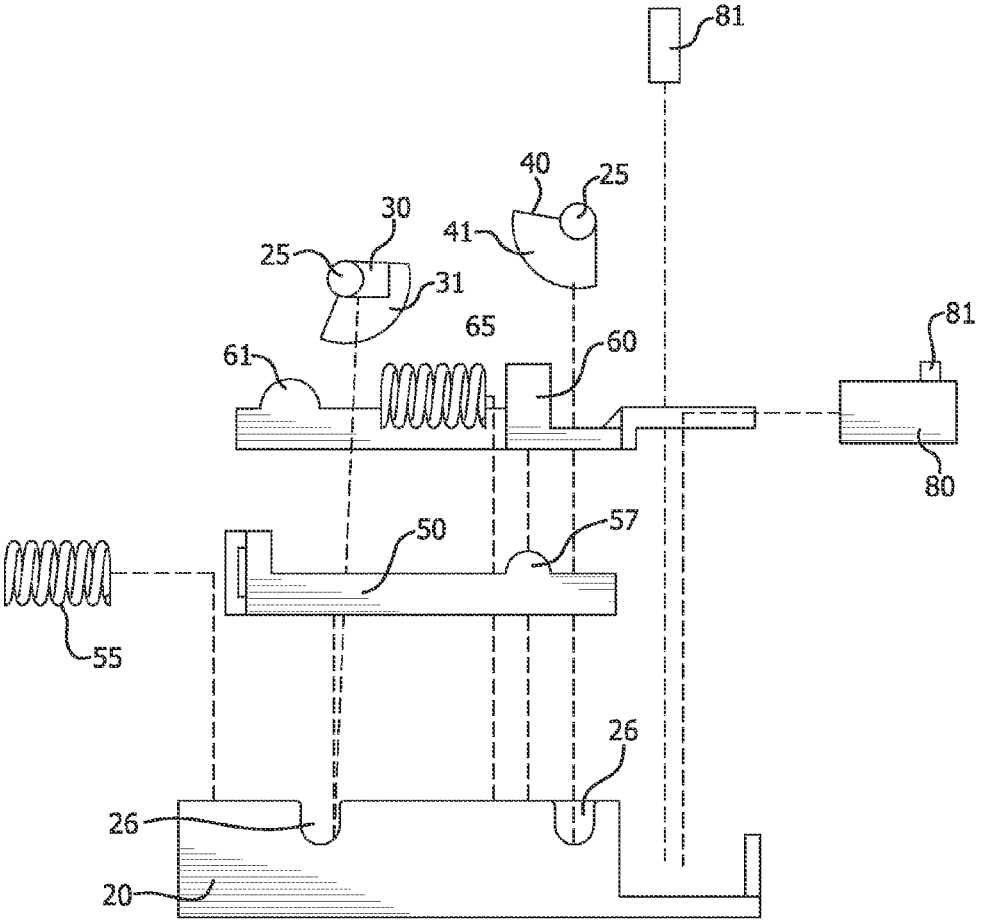
FIG. 5 is an exploded side view of the shutter assembly of FIG. 1.
Figure 6:
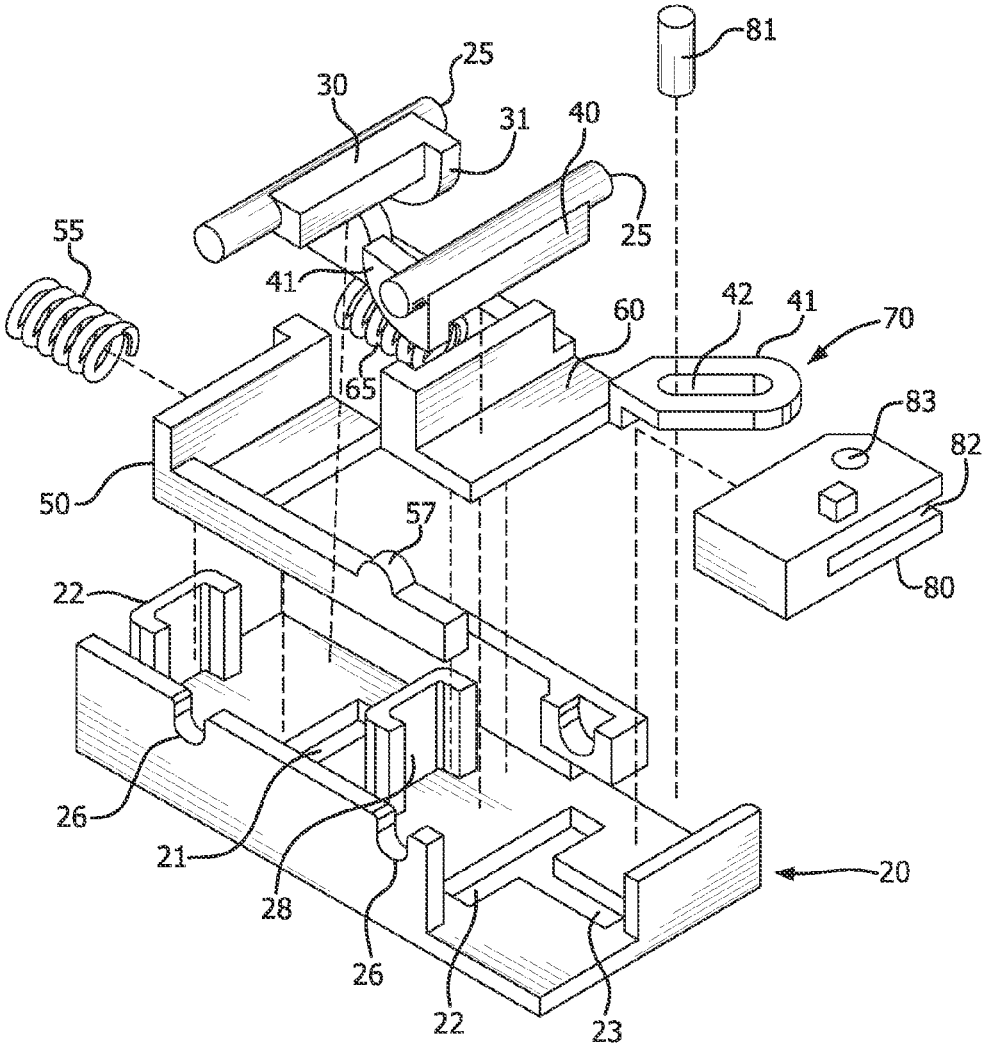
FIG. 6 is an exploded top perspective view of the shutter assembly of FIG. 1.
Figure 7:
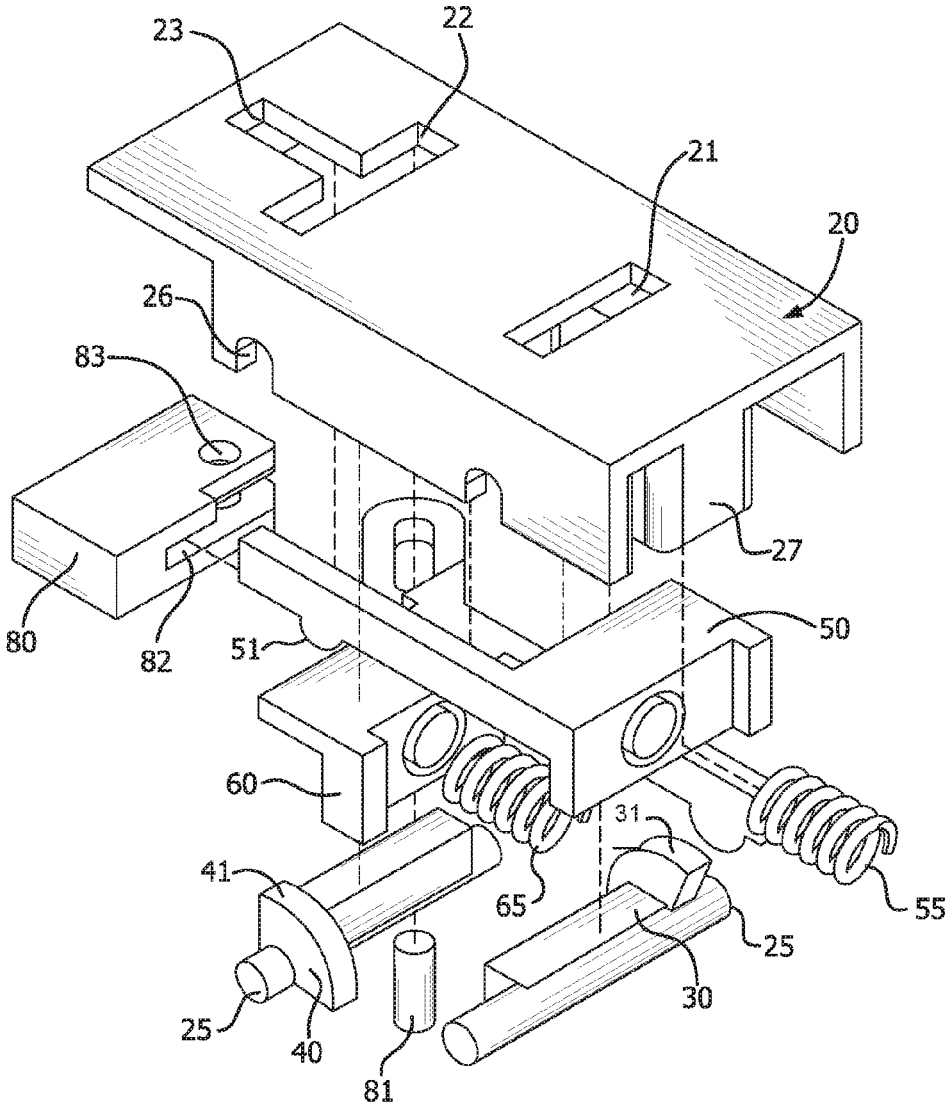
FIG. 7 is an exploded bottom perspective view of the shutter assembly of FIG.

While the present invention will be described in connection with a TR receptacle of the type having cooperating shutters generally described in U.S. Pat. No. 8,187,011 to Baldwin et al., it will be readily apparent to one skilled in the art armed with the present specification that the present invention can be applied to a multiplicity of devices, fields, and uses. In particular, the present invention may find use in connection with other types of TR receptacles where cooperating shutters do not provide sufficient clearance for a 20 A neutral blade or wherein reduction of lateral friction forces may be desirable. Finally, one skilled in the art armed with the present specification will also understand that the present system may be easily modified to include different configurations, mechanisms, methods, and kits, which achieve some or all of the purposes of the present invention.

Turning to the Figures, a TR assembly for a 20 A receptacle is depicted. The TR receptacle of the depicted embodiment includes camming "trap doors" 30, 40 and cooperation shutters 50, 60 of the type disclosed in U.S. Pat. No. 8,187,011. The hot and neutral doors 30, 40 and hot and neutral shutters 50, 60 are seated in a slide housing 20. The slide housing 20 may in turn be connected to the faceplate (not shown) of an electrical outlet.

The faceplate of a TR receptacle includes a hot blade opening and a neutral blade opening. The neutral blade opening includes a perpendicular slot that forms the "T"-shaped neutral blade receiving opening of a 20 A receptacle. In the embodiments of the invention that use a slide housing 20, the housing includes a hot blade opening 21 and a neutral blade opening 22 (including the perpendicular opening 23 for a 20 A blade) that must be uncovered for the tines of a plug blade to pass therethrough, and contact the hot and neutral electrical contacts (not shown) disposed beneath the respective openings. The housing may also include openings 26 for accepting the pivot pins 25 of the trap doors 30, 40 as well as hot and neutral spring seats 27, 28 for providing a solid surface for accepting the shutter springs 55, 65.

Returning to the top of the device, sitting below the hot blade opening of the faceplate is the hot blade trap door 30. The trap door 30 includes a cam head 31 that engages the cam receiving surface 61 of the neutral shutter 60 (which blocks access to the "neutral" electrical contact). Similarly, sitting below the neutral blade opening of the faceplate is the neutral blade trap door 40. The neutral blade trap door 40 includes a cam head 41 that engages the cam receiving surface of the 51 hot shutter 50. In operation, as the tines of a plug are inserted simultaneously into the hot and neutral openings in the faceplate, the trap doors 30, 40 rotate via pivot pins 25 on each end that are seated in dedicated pivot openings 26 of the slide housing 20.

The rotation of the trap doors 30, 40 causes the cam heads 31, 41 to cam against respective camming surfaces 51, 61 of the shutters. If sufficient force is applied to overcome the spring bias of the hot and neutral shutter springs 55, 65, then the shutters 50, 60 will slide laterally uncovering the electrical contact seated respectively beneath each shutter. As will be appreciated, the disposition of the neutral shutter 60 beneath the hot trap door 30 and the hot shutter 50 beneath the neutral door 40, requires that both tines of a plug enter the faceplate openings simultaneously. Otherwise, the individual tines will not be able to get past the shutter sitting beneath the blade opening. Accordingly, the tamper resistance required by code of the device is achieved.

As discerned from the figures, both springs 55, 65 are positioned in respective spring seats 27, 28 and positioned to bias the shutters in a direction towards the neutral blade opening of the device. Likewise, both trap doors 30, 40 are positioned to rotate in the direction away from the neutral blade opening (to push against the spring bias). This configuration allows the force of a plug being inserted into an outlet to frictionally force both shutters in the same direction. Unlike many prior art devices, the shutters are sliding in the same direction as opposed to over one another in opposite directions. As will be appreciated, when shutters are slid over one another in opposite directions, frictional forces at play necessitate additional force which may lead to a compromised lifespan for the product.

The provision of the neutral shutter spring 65 in an area central to the device and biased towards the neutral blade opening 22 provides the ability to provide sufficient clearance of a shutter to uncover the perpendicular portion 23 of the neutral blade opening in the slide body 20 and faceplate of a 20 A receptacle. To this end, as depicted in the figures, the neutral shutter 60 is provided with a cam extension 70. An integral neutral block 80 is also provided. The cam extension 70 of the presently preferred embodiment takes the form of an upwardly extending loop body 71 oriented at a roughly 45 degree angle. The loop body has a central opening 72 sized for receiving a pin 81 of the neutral block 80. In the embodiment depicted, the neutral block 80 includes a slit 82 sized to accept a portion of the cam extension 70 therein with a pin opening 83 providing the means for allowing the pin 81 to be held operably within the central opening 72 of the loop body 71 of the cam extension 70.

In operation, as the neutral shutter 60 slides laterally away from the neutral blade opening 22, the cam extension 70 moves laterally with the shutter 60. As the cam loop moves 71, the angle of the central opening 72 results in the pin 81 of the neutral block 80, as a cam follower, to be pulled upwards. The upward movement is sufficient to provide clearance for the perpendicularly oriented neutral blade of a 20 A plug to continue its downward path through the neutral opening 22 in the slide housing 20 and engage the neutral electrical contact disposed beneath.

Similarly, in operation, as the tines of a 20 A plug are removed, the spring bias of the shutters 50, 60 causes them to slide in the closed direction. The sliding of the shutters 50, 60 likewise results in the cam loop 71 sliding towards the neutral blade opening 22 and forces the block 80 into its original closed position blocking access to at least the perpendicular portion 23 of the neutral blade opening 22 of the slide body 20.

One of ordinary skill will appreciate that the exact dimensions and materials are not critical to the invention and all suitable variations should be deemed to be within the scope of the invention if deemed suitable for carrying out the objects of the invention.

Likewise, one of ordinary skill in the art will readily appreciate that it is well within the ability of the ordinarily skilled artisan to modify one or more of the constituent parts for carrying out the various embodiments of the invention. Once armed with the present specification, routine experimentation is all that is needed to decide the parameters to adjust for carrying out the present invention.

The above embodiments are for illustrative purposes and are not intended to limit the scope of the invention or the adaptation of the features described herein to particular TR receptacles. Those skilled in the art will also appreciate that various adaptations and modifications of the above-described preferred embodiments can be configured without departing from the scope and spirit of the invention. Therefore, it is to be understood that, within the scope of the appended claims, the invention may be practiced other than as specifically described.

What is claimed is:

1. A tamper resistant shutter assembly for an electrical receptacle configured to have a hot electrical contact and a neutral electrical contact comprising:

a slide housing;

a hot blade shutter disposed in said slide housing and spring biased in a closed position;

a neutral blade shutter disposed in said slide housing and spring biased in the same direction as the hot blade shutter in a closed position;

a hot blade trap door pivotably disposed above the hot electrical contact of said electrical receptacle via a pivot pin, the hot blade trap door including a first cam head that engages a first cam receiving surface of the neutral blade shutter;

a neutral blade trap door pivotably disposed above the neutral electrical contact of said electrical receptacle via a pivot pin, the neutral blade trap door including a second cam head that engages a second cam receiving surface of the hot blade shutter;

a cam extension and a neutral block having a pin, the cam extension comprising an upwardly extending loop body oriented at an approximately 45 degree angle, the loop body having a central opening sized for receiving the pin of the neutral block;

whereby the trap doors rotate via pivot pins on each end that are seated in dedicated pivot openings of the slide housing, the rotation of the trap doors causes the cam heads to cam against respective first and second camming surfaces of the hot and neutral shutters to overcome the spring bias and laterally slide the shutters to uncover the hot and neutral contacts seated respectively beneath each shutter.

2. The tamper resistant shutter assembly for the electrical receptacle of claim 1, wherein the neutral block includes a slit sized to accept a portion of the cam extension therein with a pin opening providing the means for allowing the neutral block pin to be held operably within a central opening of the loop body of the cam extension.

3. The tamper resistant shutter assembly for the electrical receptacle of claim 2, wherein the neutral blade shutter slides laterally away causing the cam extension to move laterally with the neutral blade shutter and movement of the cam loop moves whereby the angle of the central opening results in the neutral block pin to operate as a cam follower and pulled upwards sufficient to provide clearance for the perpendicularly oriented neutral blade of a 20 A plug.

4. The tamper resistant shutter assembly for the electrical receptacle of claim 2, wherein the spring bias of the shutters causes them to slide in the closed direction, the sliding of the shutters results in the cam loop sliding towards the neutral blade opening and forces the neutral block into its original closed position.

* * * * *